United States Patent [19]

Swisher, Jr.

[11] Patent Number: 4,637,753

[45] Date of Patent: Jan. 20, 1987

[54] ROAD PLANAR HAVING PARTICLE REDUCING MEANS

[75] Inventor: George W. Swisher, Jr., Oklahoma City, Okla.

[73] Assignee: CMI Corporation, Oklahoma City, Okla.

[21] Appl. No.: 672,939

[22] Filed: Nov. 19, 1984

[51] Int. Cl.[4] ..... E01C 23/12

[52] U.S. Cl. ..... 404/90; 404/92; 172/112; 299/39

[58] Field of Search ..... 404/83, 84, 75, 90, 404/96, 91, 92; 299/36, 39, 40, 41, 79, 87, 64; 172/112, 32, 52; 241/190, 243

[56] References Cited

U.S. PATENT DOCUMENTS

| | | | |
|---|---|---|---|
| 1,902,857 | 3/1933 | Jamieson | 404/90 |
| 1,921,688 | 8/1933 | McLaughlin | 404/90 |
| 2,211,263 | 8/1940 | Flynn | 404/91 |
| 2,481,679 | 9/1949 | Miller et al. | 404/90 |
| 2,905,456 | 9/1959 | Rafferty et al. | 299/39 |
| 3,375,764 | 4/1968 | Petersen | 404/90 |
| 4,139,318 | 2/1979 | Jakob et al. | 404/90 |
| 4,185,875 | 1/1980 | Swisher, Jr. et al. | 299/39 |
| 4,221,434 | 9/1980 | Swisher, Jr. et al. | 299/39 |
| 4,346,764 | 8/1982 | Rossi | 299/39 |

*Primary Examiner*—James A. Leppink
*Assistant Examiner*—Matthew Smith
*Attorney, Agent, or Firm*—Dunlap, Codding & Peterson

[57] ABSTRACT

A road planar which includes a secondary cutter in the planar behind the primary cutter with grids between the primary and secondary cutters and following the secondary cutter to size and cooperate with the secondary cutter in reducing the particle size of pavement material removed by the primary cutter. The primary cutter is rotated in an up cutting direction and breaker bars are incorporated in the planar adjacent the primary cutter to further assist in breaking up the removed pavement material.

9 Claims, 10 Drawing Figures

ROAD PLANAR HAVING PARTICLE REDUCING MEANS

BRIEF SUMMARY OF THE INVENTION

1. Field of the Invention

This invention relates generally to improvements in road planars, and particularly to a road planar having means incorporated therein for reducing the particle size of the removed road material.

2. Background of the Invention

Machines designed to remove either the top, worn surface of Portland cement or asphalt pavements, or for removing a complete layer of an asphalt pavement are generally known in the art as road planars and have come into widespread use in recent years. When road planars are used for removing all or a substantial depth of an asphalt pavement, the pavement material is removed in various particle sizes, sometimes including relatively large chunks. In order for the larger chunks of pavement material to be used in forming a new pavement layer, the chunks must be further reduced in size, such as a particle size generally known as one inch or less.

Various techniques have been employed for reducing the particle size of pavement material removed by planars, including the use of a cold mix plant travelling behind the road planar which includes a grinder and associated conveyors, screens and asphalt injection means, by means of which the removed pavement material is recycled and replaced upon the roadway to form a new pavement surface. Also, a grinding apparatus alone has been mounted on a trailer adapted to be towed by a road planar, as disclosed in U.S. Pat. No. 4,185,875. Such developments are unduly cumbersome, particularly when the road planar must be operated in fairly close quarters and reversed in direction.

The present invention contemplates the incorporation of a secondary cutter within a road planar in conjunction with one or more grids, by means of which the larger chunks of removed pavement material are reduced in particle size. The present apparatus is particularly useful in the rehabilitation of secondary roads where a precise control of the particle size is not a critical factor in the rehabilitation of the road.

DETAILED DESCRIPTION OF THE DRAWINGS

Figure 1:
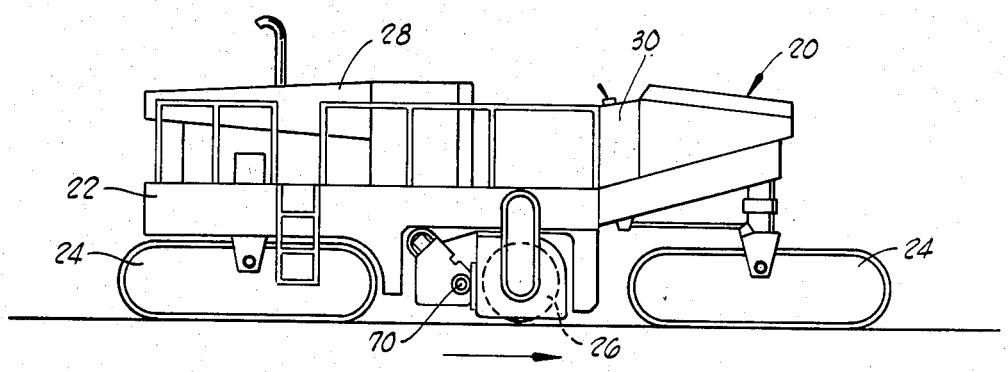
FIG. 1 is a side view of a road planar having the particle reducing means of this invention incorporated therein.

Referring to the drawings in detail, and particularly to FIG. 1, reference character 20 generally designates a road planar which includes a main frame 22 supported on tracks 24 for movement along a roadway in the direction indicated by the arrow when operated in a planing or excavating mode. A primary cutter 26 is rotatably supported in the central portion of the machine in a position to engage the roadway and is driven by the main engine 28 through any suitable drive system. The engine 28 is also employed to power the tracks 24. A control console 30 is provided in the forward portion of the machine by means of which the operator can control the movement and operation of the machine. Such a planar is disclosed in U.S. Pat. No. 4,139,318.

Figure 2:
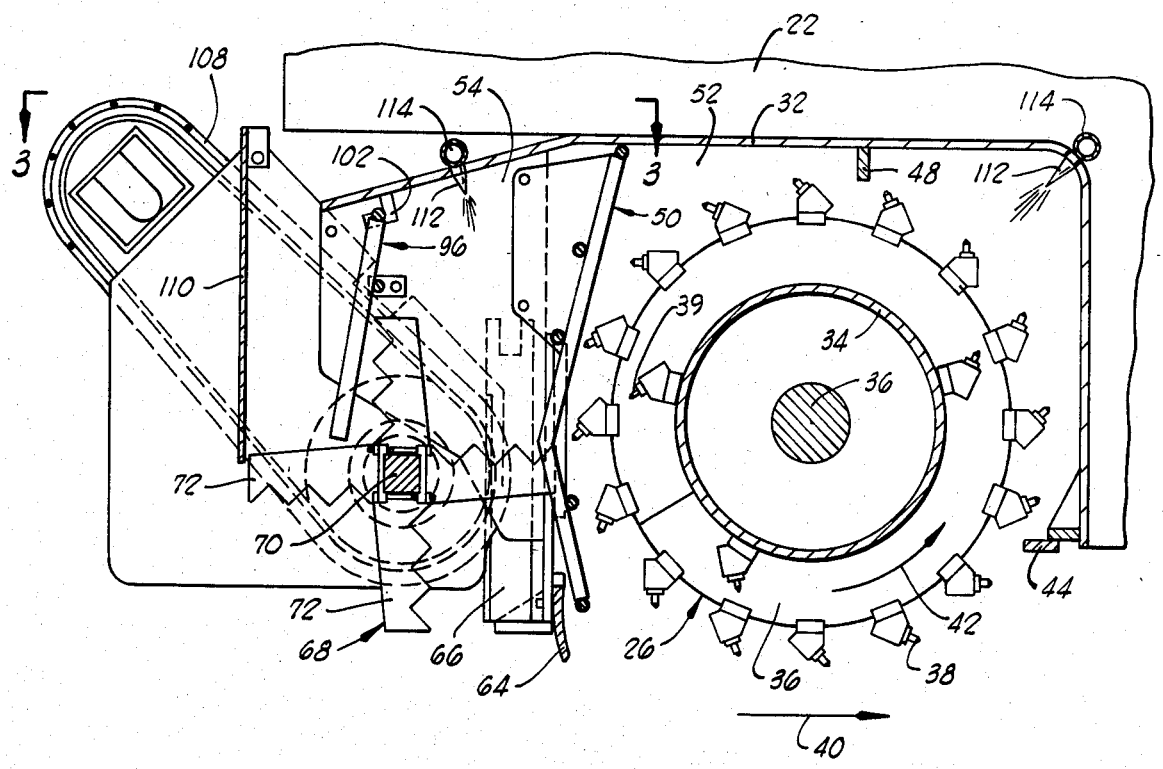
FIG. 2 is an enlarged, schematic side view of the main operating components of the planar of FIG. 1.

As shown more clearly in FIG. 2, the primary cutter 26 is supported in a housing 32 suitably carried by the frame 22 of the planar. The primary cutter 26 basically comprises a drum 34 mounted on a shaft 36 and the shaft 36 is suitably supported in the sides of the housing 32 in such a manner that the primary cutter 26 extends transversely across the planar. A series of helical flights 36 are secured around the drum 34 and carry a plurality of cutting teeth or bits 38 used to remove pavement material from the roadway. The flights 36 move the removed pavement material generally toward the center of the planar. An example of such a primary cutter is disclosed in detail in the above-mentioned U.S. Pat. No. 4,139,318. In addition, a series of cutter teeth or bits 39 are secured around the drum 34 between the flights 36 to assist in breaking up large chunks of pavement material removed by the cutter.

The primary cutter 26 is turned in such a direction that the cutter makes what is commonly known in the industry as an up cut. As viewed in FIG. 2, the lower arrow 40 indicates the direction of movement of the planar and the arrow 42 indicates the direction of rotation of the primary cutter 26. A first breaker bar 44 is secured across the forward end of the housing 32 adjacent the paths of movement of the outer tips of the cutting bits 38. The breaker bar 44 extends transversely across the front end of the housing 32 and has a total length at least the length of the primary cutter 26. A second breaker bar 48 is secured in the upper portion of the housing 32 to extend down into close proximity with the outer extremities of the paths of movement of the cutting teeth 38. The breaker bar 48 also extends across the entire length of the primary cutter 26 and is preferably positioned a short distance forwardly of a verticle center line through the primary cutter drive shaft 36.

Figure 9:
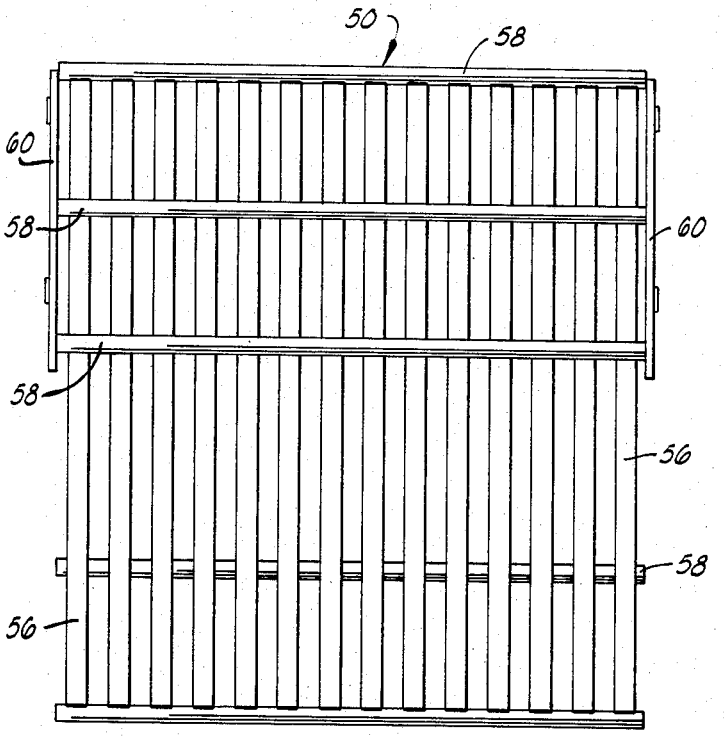
FIG. 9 is an elevational view of another grid used in the planar.
Figure 10:
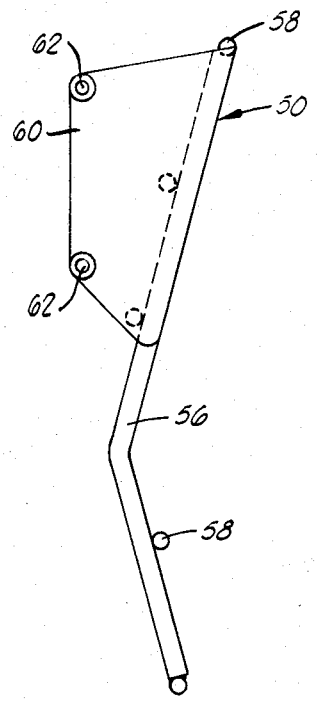
FIG. 10 is a side view of the grid shown in FIG. 9.

A grid 50 separates the housing 32 into a forward, primary cutting chamber 52 and a rearward, secondary cutting chamber 54. As shown most clearly in FIGS. 9 and 10, the grid 50 basically comprises a plurality of generally vertically extending bars 56 secured in horizontally spaced apart relation by a series of transverse rods 58, the bars and rods being secured together, as by welding. Side plates 60 are secured to the opposite ends of the uppermost rods 58 and are provided with bolt receiving apertures 62 by means of which the primary grid is secured to the side walls of the housing 32 to position the primary grid 50 immediately to the rear of the primary cutter 26. As shown in FIG. 2, the path of movement of the tips of cutting teeth 38 pass in close proximity with the central portion of the primary grid 50, for purposes to be described.

The mold board 64 of the planar 20 is supported in the housing 32 by a mechanism 66 by means of which the mold board is raised and lowered or "floats" in the same manner as disclosed in the above-mentioned U.S. Pat. No. 4,139,318, and is located immediately to the rear of the primary grid 50 generally at a level corresponding to the lowermost portion of the paths of movement of the outer tips of the cutting teeth 38 of the primary cutter 26.

Figure 4:
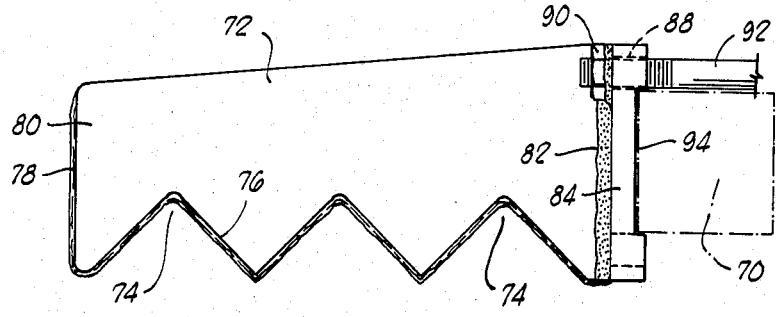
FIG. 4 is a side view of a typical cutting bar of the secondary cutter.
Figure 5:
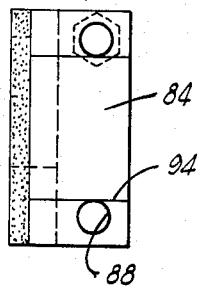
FIG. 5 is an end view of the cutter bar shown in FIG. 4.
Figure 6:
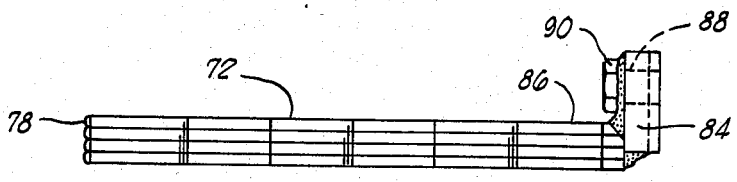
FIG. 6 is an elevational view of the cutter bar shown in FIG. 4 as viewed from the bottom of the illustration in FIG. 4.

A secondary cutter generally designated at 68 is mounted in the secondary cutting chamber 54 of the housing 32 to the rear of the primary grid 50. The secondary cutter 68 basically comprises a shaft 70 suitably journalled in the side walls of the housing 32 to extend transversely across the housing 32, and a plurality of arms or cutter bars 72 extending radially from the shaft 70. As shown in FIGS. 4, 5 and 6, each cutter bar or arm 72 comprises a flat plate having a plurality of serrations 74 in the leading edge 76 thereof. Beads 78 of suitable hardfacing material are formed around the outer end 80 of the bar and along the leading edge 76 of the bar to increase the service life of the cutter bars. The inner end 82 of each cutter bar is secured, as by welding, to a rectangularly shaped mounting plate 84. Each mounting plate 84 extends from one side 86 of the respective bar and has a pair of apertures 88 extending therethrough. A nut 90 is secured, as by welding, to the face of each mounting plate adjacent the respective cutter bar in a position to be aligned with one of the apertures 88 to receive a connecting rod 92, by means of which the respective cutter bar 72 is secured to the shaft 70. As shown most clearly in FIG. 4, the shaft 70 is square in cross section over the length thereof on which the cutter bars 72 are mounted, and each mounting plate 84 has a rectangular notch 94 in the face thereof opposite the respective cutter bar to fit snugly with the adjacent side of the shaft 70 It will be apparent that when a pair of opposing cutter bars 72 are mounted on the shaft 70, there will be a pair of the connecting bolts 92 interconnecting the opposed mounting plates 84 to securely hold the cutter bars in engagement with and in the proper position with respect to the shaft 70. The cutter bars 72 are sized to move between the central portions of the vertical bars 56 (FIG. 9) of the primary grid 50 for purposes to be described.

Figure 7:
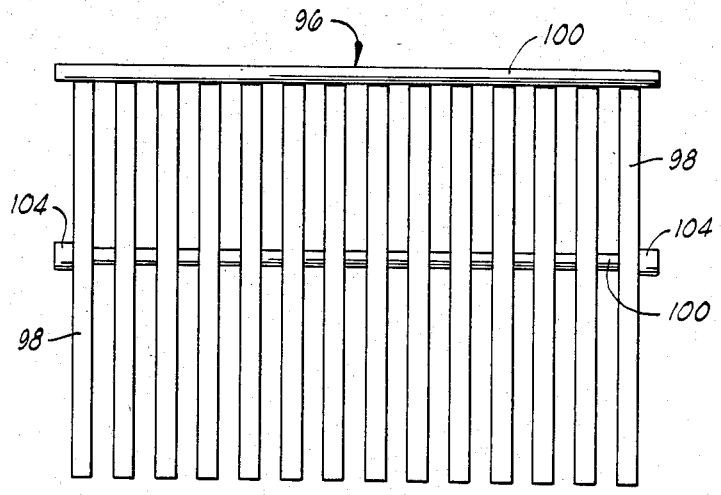
FIG. 7 is an elevational view of one of the grids employed in the planar in association with a secondary cutter.
Figure 8:
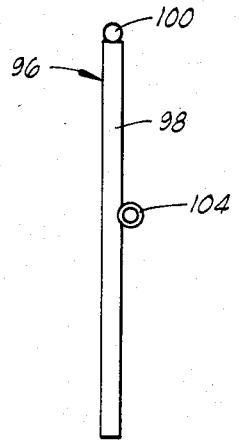
FIG. 8 is a side view of the grid shown in FIG. 7.

A secondary grid 96 (FIG. 2) is secured in the secondary cutting chamber 54 to extend downwardly and slightly rearwardly from the top of the housing 32. As shown in FIGS. 7 and 8, the secondary grid 96 comprises a series of generally vertically extending bars 98 held in horizontally spaced apart relationship by a pair of transversely extending rods 100. The opposite ends of the upper rod 100 are held in L-shaped hangars 102 (FIG. 2) and the opposite ends of the lower rod 100 are provided with sleeves 104 (FIGS. 7 and 8) which receive bolts (not shown) extending from the sides of the housing 32 to maintain the secondary grid 96 in the proper orientation in the housing 32. The horizontal spacing of the vertical bars 98 of the secondary grid 96 are such to closely receive the cutter bars 72 of the secondary cutter 68 when the secondary cutter is rotated.

Figure 3:
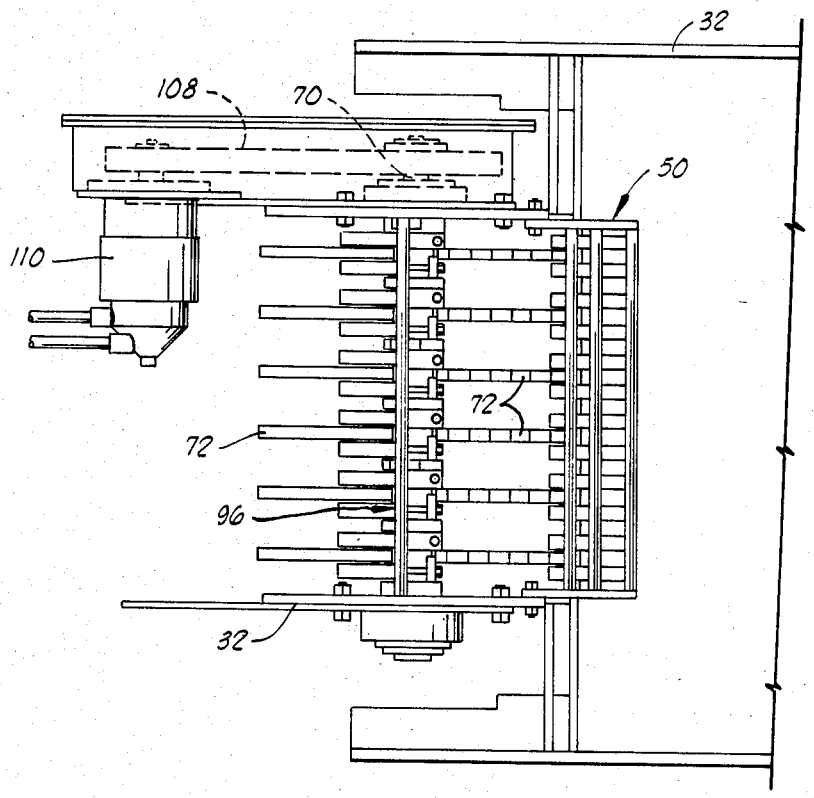
FIG. 3 is a sectional view as taken along lines 3—3 of FIG. 2 with some components of the machine removed for clarity of illustration.

As shown in FIG. 3, one end of the shaft 70 is connected to a chain drive 108 driven by a hydraulic motor 110 suitably secured in the housing 32, by means of which the secondary cutter 68 is rotated in a counterclockwise direction when viewed as in FIG. 2.

A shield 110 (FIG. 2) extends transversely across the housing 32 from a point above the upper end of the secondary grid 96 to a point approximately even with the shaft 70 of the secondary cutter 68.

OPERATION

With the primary cutter 26 and secondary cutter 68 turning in a counterclockwise direction as viewed in FIG. 2, and with the planar 20 being moved forwardly as indicated by the arrow 40, the cutter teeth 38 dislodge pavement material which is carried upwardly and rearwardly by the cutter teeth 38. The larger chunks of removed pavement material are engaged and at least partially broken up by the first breaker bar 44. The chunks of removed pavement material are further broken up by the upper breaker bar 48 as the material moves upwardly and rearwardly through the primary cutting chamber 52.

From the second breaker bar 48, the removed pavement material is directed on rearwardly in the primary cutting chamber 52 against the primary grid 50. The chunks or particles of removed pavement material which are not sufficiently small to pass through the openings between the vertical bars 56 of the primary grid 50 will impinge on the primary grid and be engaged by the cutter bars 72 of the secondary cutter 68 to be further broken up and moved upwardly and rearwardly through the secondary cutting chamber 54. The removed pavement material entering the secondary cutting chamber 54 will be, at least mostly, contacted by the radial cutting bars 72 of the secondary cutter 68 and forced against and through the secondary grid 96 to provide a further reduction in the particle size of the larger particles of removed pavement material. The removed pavement material will then be engaged by the shield 110 and directed downwardly onto the pavement surface underneath the planar and will be deposited in a windrow on the roadway behind the planar 20. The windrowed, removed pavement material will then all have a maximum particle size depending upon the size of the spacing between the verticle bars of the primary and secondary grids and can then be spread onto the roadway surface behind the planar 20 or picked up and further processed if desired.

When it is desired to spread and compact the removed pavement material back onto the roadway surface immediately behind the planar 20, a plurality of spray nozzles 112, connected to conduits 114 may be employed to spray liquid asphalt cement onto the removed pavement material. Preferably, a series of the spray nozzles 112 are mounted in the forward end of the housing 32 above the primary cutter 26 and a series of spray nozzles 112 are also preferably located in the top of the housing 32 above the secondary cutter 68, whereby the liquid asphalt cement will be sprayed onto the removed pavement material while it is being mixed by the action of the primary and secondary cutters. When the liquid asphalt cement is desired, the conduits 114 will be suitably connected to a supply (not shown) of liquid asphalt. In the alternative, the spray nozzle 112 may be used to spray water onto the removed pavement material for dust suppression purposes.

Changes may be made in the combination and arrangement or parts or elements as heretofore set forth in the specification and shown in the drawings without departing from the spirit and scope of the invention as defined in the following claims.

What is claimed is:

1. In a road planar adapted to travel in a forward direction during a planing operation:

housing means forming a primary cutting chamber and a secondary cutting chamber to the rear of and communicating with the primary cutting chamber;

primary cutter means in the primary cutting chamber mounted for rotation about an axis extending transversely with respect to the planar and adapted to remove chunks of pavement material and direct said removed pavement material rearwardly toward the secondary cutting chamber;

first grid means carried by the housing means between the primary and secondary cutting chambers for sizing the removed pavement material moving from the primary cutting chamber to the secondary cutting chamber;

secondary cutting means mounted in the secondary cutting chamber having radial arms thereon, said secondary cutting means being mounted for rotation whereby said arms move through said first grid means to break up removed pavement material impinging on said first grid means; and second grid means carried by the housing means in the secondary cutting chamber arranged to the rear of the first grid means in the path of movement of the removed pavement material in a position where said arms pass therethrough to further break up and size the removed pavement material.

2. A road planar as defined in claim 1 characterized further to include:

drive means carried by the housing means for driving the primary cutter means in an up cutting direction; and a breaker bar carried by the housing means at the forward end of the primary cutting chamber adjacent the path of movement of the primary cutter means to assist in breaking up removed pavement material.

3. A road planar as defined in claim 2 characterized further to include a second breaker bar carried by the housing means in the upper portion of the primary cutting chamber adjacent the path of movement of the primary cutting means.

4. A road planar as defined in claim 1 characterized further to include spray means in the primary cutting chamber arranged to spray liquid onto the removed pavement material.

5. A road planar as defined in claim 4 characterized further to include a supply of liquid asphalt carried by the housing means and means connecting said supply to the spray means.

6. A road planar as defined in claim 1 wherein the secondary cutting means is mounted in the housing means to rotate on an axis extending transversely with respect to the planar; and wherein each of said grid means includes a plurality of generally vertically extending, horizontally spaced bars positioned to receive said arms therebetween.

7. A road planar as defined in claim 1 wherein said radial arms each comprises a flat bar having serrations in the leading edge thereof.

8. A road planar as defined in claim 7 wherein the secondary cutting means includes a shaft of substantially square cross section; each of said bars has a mounting plate secured on one end thereof having a slot therein shaped to mate with said shaft; and connecting means securing the mounting plates of dimetrically opposed arms on the shaft.

9. A road planar as defined in claim 6 characterized further to include means for driving the secondary cutting means in a direction for moving said arms upwardly through the first grid means and downwardly through the second grid means.

* * * * *